US010471454B2

(12) United States Patent
Goettke

(10) Patent No.: US 10,471,454 B2
(45) Date of Patent: Nov. 12, 2019

(54) DISPENSER FOR LIQUID TO PASTY SUBSTANCES

(71) Applicant: RPC Bramlage GmbH, Lohne (DE)

(72) Inventor: Sabine Goettke, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 15/757,091

(22) PCT Filed: Sep. 21, 2016

(86) PCT No.: PCT/EP2016/072442
§ 371 (c)(1),
(2) Date: Mar. 2, 2018

(87) PCT Pub. No.: WO2017/050832
PCT Pub. Date: Mar. 30, 2017

(65) Prior Publication Data

US 2018/0178233 A1 Jun. 28, 2018

(30) Foreign Application Priority Data

Sep. 23, 2015 (DE) ..... 10 2015 116 075
Apr. 1, 2016 (DE) ..... 10 2016 105 998

(51) Int. Cl.
*B05B 11/00* (2006.01)

(52) U.S. Cl.
CPC ..... *B05B 11/3049* (2013.01); *B05B 11/0044* (2018.08); *B05B 11/306* (2013.01); *B05B 11/3047* (2013.01)

(58) Field of Classification Search
CPC ..... B05B 11/3049; B05B 11/0044; B05B 11/3047; B05B 11/0029; B05B 11/306; B05B 11/3074
See application file for complete search history.

(56) References Cited

U.S. PATENT DOCUMENTS 4,371,099 A * 2/1983 Foster ..... B05B 11/3047 222/153.13
4,377,106 A * 3/1983 Workman ..... B05B 11/3059 222/153.02

(Continued)

FOREIGN PATENT DOCUMENTS

CN 101391686 A 3/2009
EP 0 685 269 A2 12/1995

(Continued)

OTHER PUBLICATIONS

Response to European Patent Office by German Patent Attorney regarding PCT/EP2016/072442 dated Jul. 20, 2017 with an English translation of the relevant parts.

(Continued)

*Primary Examiner* — David P Angwin
*Assistant Examiner* — Bob Zadeh
(74) *Attorney, Agent, or Firm* — Collard & Roe, P.C.

(57) ABSTRACT

A dispenser for liquid to pasty substances, has a dispenser head and a dispenser body. The dispenser head is movable in a displacement direction perpendicular to the horizontal bearing plane between an extended position and a retracted position for carrying out a pumping movement, the dispenser head can rotate relative to the dispenser body in such a way that the dispenser mouth moves in a horizontal plane when the dispenser head is rotated. In order to provide an advantageous design of a dispenser of the type in question, the dispenser has a tamper-proofing part which is secured to two parts of the dispenser which can rotate relative to each other, at one of the parts by a rupturable material bridge, and the material bridge can be ruptured in the course of a rotation of the dispenser head.

8 Claims, 21 Drawing Sheets

(56) References Cited

U.S. PATENT DOCUMENTS

| | | | | |
|---|---|---|---|---|
| 4,384,660 | A * | 5/1983 | Palmisano | B05B 11/3059 222/153.07 |
| 5,257,724 | A | 11/1993 | Steijns | |
| 5,497,915 | A * | 3/1996 | Wass | B05B 11/3015 222/153.07 |
| 5,975,370 | A * | 11/1999 | Durliat | B05B 11/0027 222/153.06 |
| 8,104,643 | B2 * | 1/2012 | Pruvot | B05B 11/3059 222/153.06 |
| 8,944,292 | B2 | 2/2015 | Moreau | |
| 2004/0182884 | A1 * | 9/2004 | Tada | B05B 11/3057 222/153.13 |
| 2005/0035154 | A1 * | 2/2005 | Meshberg | B05B 11/3059 222/153.13 |
| 2007/0023452 | A1 * | 2/2007 | Tseng | B05B 11/306 222/153.06 |
| 2007/0102449 | A1 * | 5/2007 | Tseng | B05B 11/0032 222/153.13 |
| 2008/0197149 | A1 * | 8/2008 | Law | B05B 11/3001 222/153.13 |
| 2010/0018997 | A1 * | 1/2010 | Faneca Llesera | B05B 11/0027 222/153.06 |
| 2011/0240679 | A1 * | 10/2011 | Langlos | B05B 11/3049 222/321.7 |
| 2012/0223103 | A1 * | 9/2012 | Moreau | B05B 11/3049 222/153.06 |
| 2014/0097207 | A1 * | 4/2014 | Szymiczek | B05B 11/0032 222/153.13 |
| 2018/0178233 | A1 * | 6/2018 | Goettke | B05B 11/0029 |

FOREIGN PATENT DOCUMENTS

| | | | | |
|---|---|---|---|---|
| FR | 2952620 | A1 | 5/2011 | |
| GB | 2238088 | A * | 5/1991 | B05B 11/3059 |
| WO | 93/03857 | A2 | 3/1993 | |
| WO | 2016/166540 | A2 | 10/2016 | |

OTHER PUBLICATIONS

International Search Report of PCT/EP2016/072442, dated Dec. 20, 2016.

* cited by examiner

DISPENSER FOR LIQUID TO PASTY SUBSTANCES

CROSS REFERENCE TO RELATED APPLICATIONS

This application is the National Stage of PCT/EP2016/072442 filed on Sep. 21, 2016, which claims priority under 35 U.S.C. § 119 of German Application No. 10 2015 116 075.7 filed on Sep. 23, 2015 and German Application No. 10 2016 105 998.6 filed on Apr. 1, 2016, the disclosures of which are incorporated by reference. The international application under PCT article 21 (2) was not published in English.

TECHNICAL FIELD

The invention pertains to a dispenser for liquid to pasty substances with a dispenser head and a dispenser body, wherein the substance can be dispensed from a dispenser mouth of the dispenser head by pumping and the dispenser head can, when the dispenser is seated on a horizontally aligned bearing plane, moved between an extended position and a retracted position in a displacement direction extending perpendicular to the horizontal bearing plane in order to carry out a pumping motion, and wherein the dispenser head is furthermore rotatable relative to the dispenser body in such a way that the dispenser mouth moves in a horizontal plane during a rotation of the dispenser head, wherein the dispenser features a tamper-proofing part, which is secured on two parts of the dispenser that can rotate relative to one another, and wherein the tamper-proofing part is secured on one of the two parts by means of a rupturable material bridge and the material bridge can be ruptured during the course of a rotation of the dispenser head.

PRIOR ART

Dispensers of the type in question are known. In this context, we refer, for example, to publication EP 0 685 269 A2.

CN 101391686 A discloses a dispenser, in which a tamper-proofing part, which is connected to the dispenser head, is connected to the dispenser body by means of rupturable material bridges. The connection to the dispenser head serves for producing a rotational coupling by means of a ring section of the tamper-proofing part, which encloses an outwardly protruding dispensing tube.

With respect to the prior art, we furthermore refer to publication FR 2952620 A1. The dispenser known from this publication is provided with a tamper-proofing ring, which is connected to a dispenser head by means of rupturable material bridges. During the course of an unscrewing process, the tamper-proofing ring is moved downward with the dispenser body by cooperating interlocking projections of the tamper-proofing part such that the material bridges rupture. WO93/03857 A2 discloses a tamper-proofing part in the form of a tear-off tab that, however, can only be ruptured in itself. U.S. Pat. No. 5,257,724 A discloses a trigger pump, in which a screw cap, which initially has to be unscrewed in order to use the trigger pump, is provided with a tamper-proofing ring that is connected to the screw cap by means of tear-off webs.

SUMMARY OF THE INVENTION

The invention is based on the objective of advantageously designing a dispenser of the type in question with respect to the tamper-proofing part.

This objective is attained with a dispenser—featuring a tamper-proofing part, which is secured on two parts of the dispenser that can rotate relative to one another, wherein the tamper-proofing part is secured on one of the two parts by means of a rupturable material bridge and the material bridge can be ruptured during the course of a rotation features interlocking projections for cooperating with interlocking recesses of the dispenser head.

The tamper-proofing part serves for indicating and thereby ensuring the original condition of the dispenser. An intact tamper-proofing part indicates the sealed condition of the dispenser whereas a rupture of the tamper-proofing part and/or the material bridge signals an unsealed condition and may indicate that the initial use of the dispenser has already taken place.

The tamper-proofing part may be arranged on the dispenser, particularly on the dispenser body, in such a way that it prevents the dispenser head from rotating from a normal position in the direction of a working position in the secured original condition of the dispenser. In this case, the normal position is preferably a position, in which no substance can be dispensed as a result of a pumping motion.

The tamper-proofing part can be broken, e.g. by rupturing the material bridge, as a result of a rotation of the dispenser head from the normal position in the direction of the working position. This is noticeable for the user. Subsequently, the securing position of the tamper-proofing part preferably can no longer be assumed.

The broken tamper-proofing part reliably indicates that the dispenser head has been rotationally displaced from its normal position in the direction of the working position at least once.

The tamper-proofing part features interlocking projections for cooperating with interlocking recesses of the dispenser head. These interlocking recesses may be respectively realized, for example, in the form of recesses, into which the interlocking projections of the tamper-proofing part engage, or in the form of opposite projections that flank these interlocking projections.

The material bridges may be directly formed by the interlocking projections or parts thereof.

It would furthermore be possible that the dispenser head is in the retracted position when the tamper-proofing part is intact. The retracted position preferably corresponds to the substance dispensing position of the dispenser head. Accordingly, the dispenser is delivered in the retracted position of the dispenser head when the tamper-proofing part is intact.

A displacement of the dispenser head into the extended position is only possible when the tamper-proofing part is broken, for example ruptured, wherein a pump chamber is filled with the substance as a result of the vacuum acting thereupon during the course of such a linear displacement along the vertical axis.

In a preferred embodiment, the extended position of the dispenser head can only be assumed in the position of the dispenser head, in which it is rotated relative to the normal position. In the delivery condition of the dispenser, the tamper-proofing part forms a surmountable rotary lock of the dispenser head.

In any case, the dispenser head is preferably spring-loaded in the direction of the extended position at the end of the rotation from the normal position. For example, the dispenser head may be supported on the dispenser body, which is fixed relative to the dispenser head, by means of a spring. However, the spring force may also result, for example, from an elastic restoring force of one or more cooperating parts of the dispenser head and/or the dispenser body.

The tamper-proofing part may be connected to the dispenser body in its intact condition. The tamper-proofing part is preferably realized integrally with and of the same material as the dispenser body in the form of material bridges, particularly in a plastic injection molding process. The tamper-proofing part is at the same time interlocked with the dispenser head in order to produce a rotational coupling.

The tamper-proofing part can be broken during the course of the rotation of the dispenser head in that the connection between the tamper-proofing part and the dispenser head is ruptured in the region of the multiple material bridges, which are preferably distributed over the circumference of the dispenser head, as a result of shearing forces acting thereupon. The preferably integral connecting zone is correspondingly prepared, for example perforated. In this context, a web-like connection would also be possible such that the tamper-proofing part is only partially connected to the dispenser body over the circumference.

The deliberately surmountable rotary lock of the dispenser head may be achieved in that the dispenser head features over its circumference one or more material bridges, which respectively engage, for example, between two connections of the tamper-proofing part to the dispenser body. In this way, the projections of the dispenser head engaging between two connections can promote the shearing effect for separating the tamper-proofing part from the dispenser body when the dispenser head is rotated relative to the dispenser body.

In a potential embodiment, the interlocking projections and the interlocking recesses may be covered by a skirt region of the dispenser head at least while the tamper-proofing part is intact. The coverage is preferably complete.

After the tamper-proofing part has been torn off the dispenser body as a result of a rotation of the dispenser head, the tamper-proofing part may in a potential embodiment remain on an associated neck of the dispenser body, namely in a position that does not impair the ability of the dispenser head to rotate relative to the dispenser body. Subsequently, the tamper-proofing part preferably lies loosely underneath the dispenser head, but is no longer connected to the dispenser body and therefore freely rotatable.

The tamper-proofing part may also feature, for example, a tab-like handle, by means of which the tamper-proofing part can be removed from the dispenser body after it has been ruptured. If applicable, the tamper-proofing part can also be separated and removed from the dispenser body with the aid of this handle prior to a rotation of the dispenser head by being ruptured over its circumference, whereupon the dispenser head is freely rotatable.

The tamper-proofing part may comprise a tamper-proofing ring extending underneath the dispenser mouth. Such tamper-proofing ring may extend over the entire circumference of a dispenser head neck that telescopically cooperates with the dispenser body or, if applicable, only over a partial circumference, which preferably amounts to more than 50 percent and up to 98 percent of the circumference of the dispenser head neck.

BRIEF DESCRIPTION OF THE DRAWINGS

The invention is described in greater detail below with reference to the attached drawings that, however, merely show an exemplary embodiment. A component, which is described with reference to one of the exemplary embodiments and not replaced with a different component in another exemplary embodiment, is therefore also described as a potentially existing component in this other exemplary embodiment. In the respective drawings.

DESCRIPTION OF THE EMBODIMENTS

Figure 1:
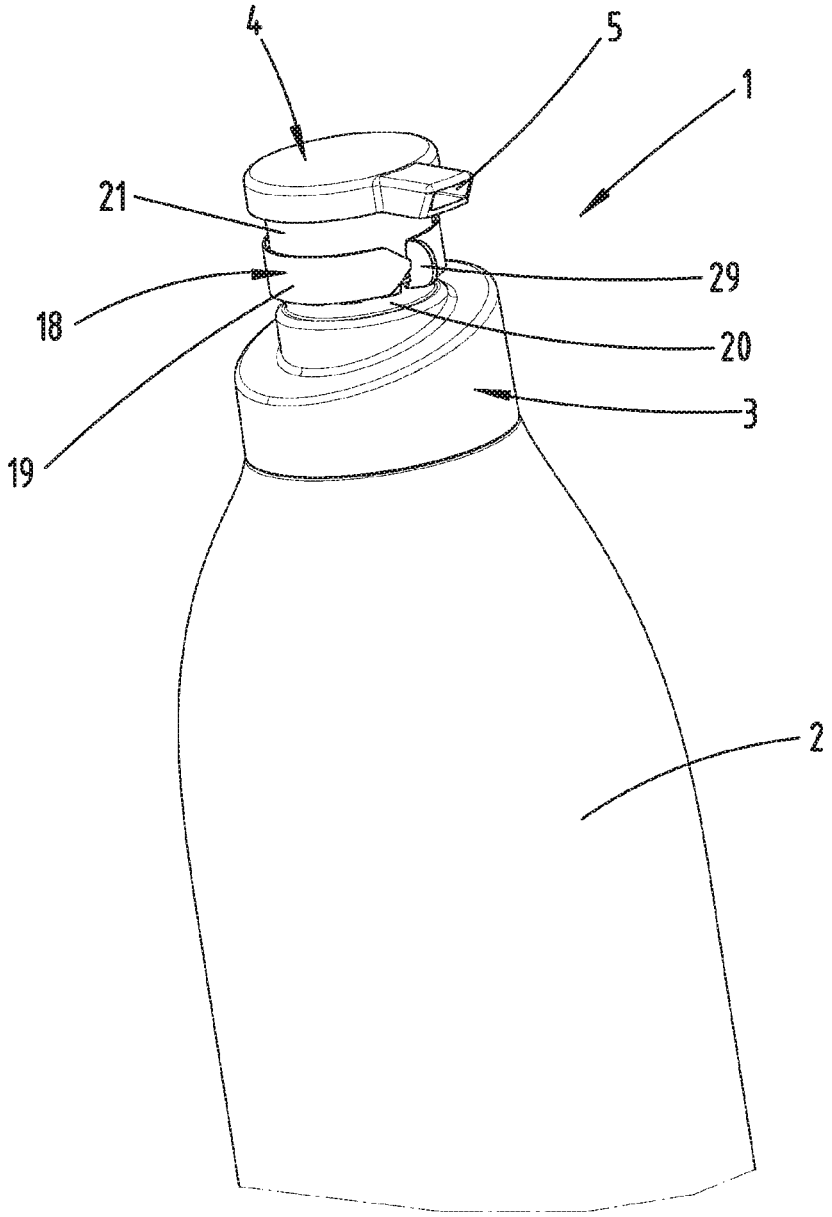
FIG. 1 shows a perspective representation of a dispenser with a dispenser head in the tamper-proof closed position.
Figure 2:
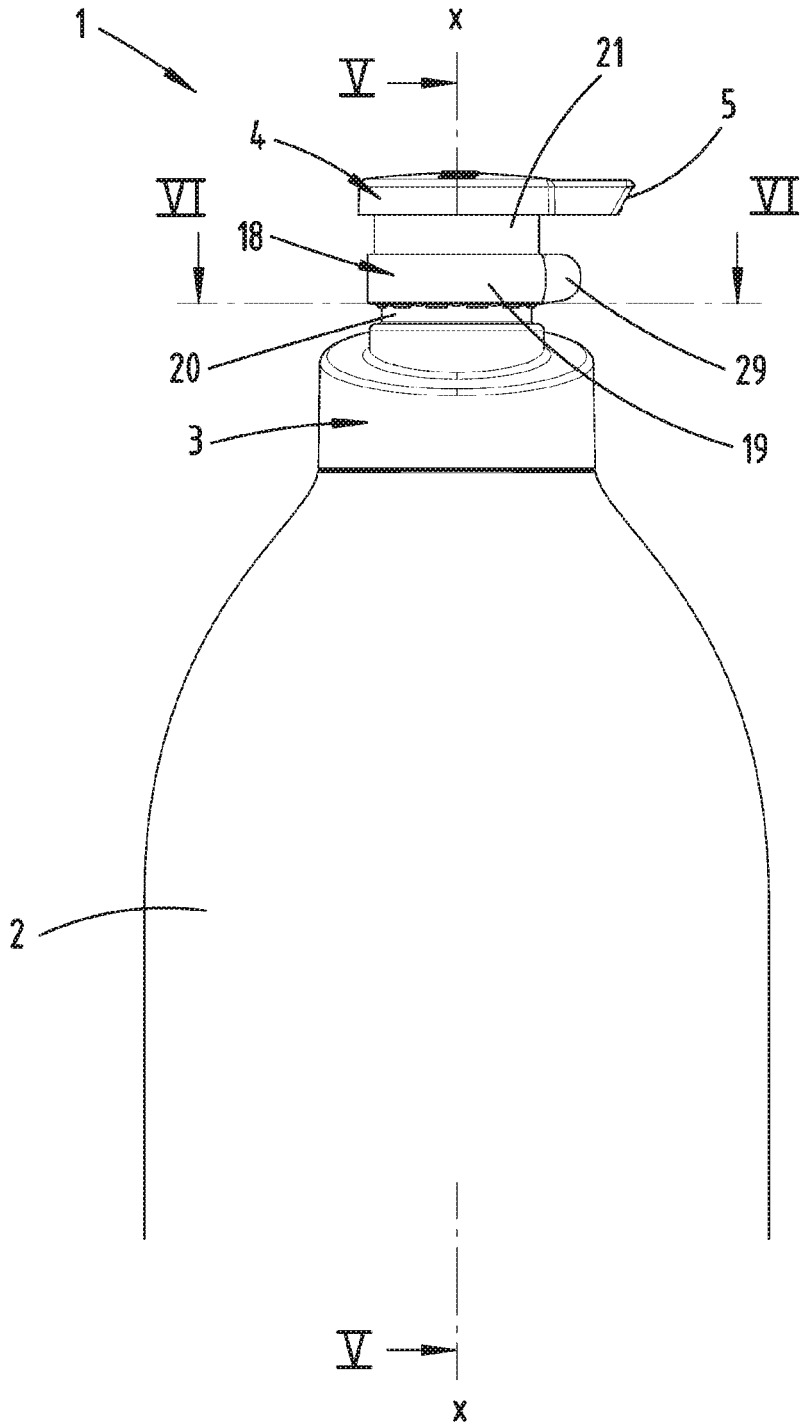
FIG. 2 shows a side view of the dispenser in the position according to FIG. 1.
Figure 3:
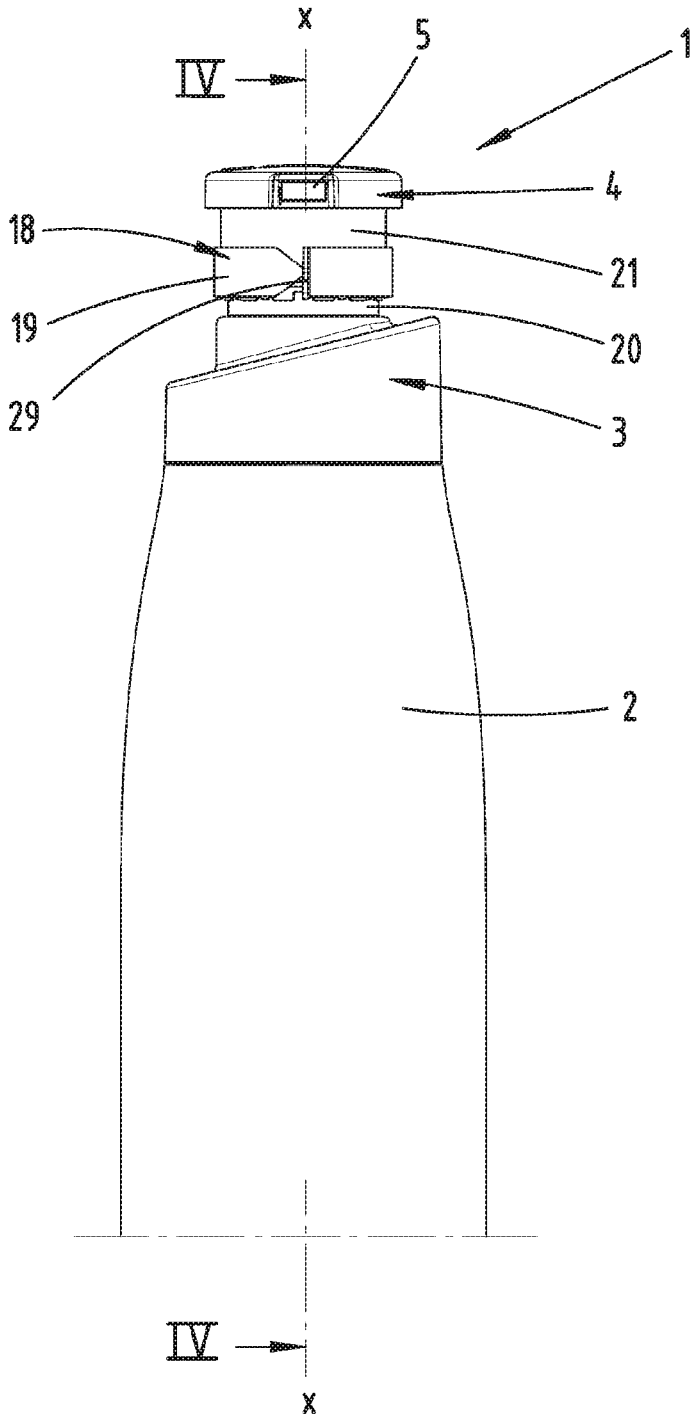
FIG. 3 shows a front view of the dispenser according to FIG. 1 and FIG. 2.

A first embodiment of a dispenser 1 for liquid to pasty substances is initially described below with reference to FIGS. 1-16.

The dispenser 1 essentially comprises a dispenser body 3 that can be arranged, particularly screwed, on a container 2, as well as a dispenser head 4 with a dispenser mouth 5.

In order to dispense the substance stored in the container 2, the dispenser head 4 can be displaced between an extended position and a retracted position perpendicular to a horizontally aligned bearing plane, on which the dispenser 1 may be seated. The displacement direction is identified by the reference symbol V; see for example FIG. 14. This makes it possible to carry out a pumping motion, wherein the substance is dispensed through the dispenser mouth 5 in the retracted position of the dispenser head 4, i.e. in its lowered position, and the substance is drawn from the container 2 into a pump chamber 6 during the course of the displacement of the dispenser head 4 into the extended position.

The pump chamber 6 is fluidically arranged between an inlet valve 7 and an outlet valve 8.

The inlet valve 7 is preferably formed on the side of the dispenser body. A substance suction tube 9 may be connected to the inlet valve 7 on the side facing away from the pump chamber 6.

A pump piston 10 adjoins the inner side of the pump chamber wall 30 enclosing the pump chamber 6 in a sealed fashion. The pump piston 10 is connected to the dispenser head 4 by the wall of a dispensing tube 11, which essentially extends coaxial to the dispenser axis x, and can be displaced between the extended position and the retracted position of the dispenser head 4 by means of the dispenser head 14.

The dispenser head 4 can be moved relative to the fixed dispenser body 3 along the dispenser axis x, as well as in the circumferential direction about the dispenser axis x.

The dispensing tube 11 is essentially divided into two parts and therefore composed, in particular, of two tubular sections 12 and 13 that can be moved relative to one another. The section 13 preferably carries the pump piston 10 on its bottom side and is furthermore preferably guided in the pump chamber 6 such that it is non-rotatable relative to the dispenser body 3, but displaceable in the axial direction. The rotational blocking may be achieved, for example, by means of a rib that is formed on an outer wall of the section 13 and vertically movable in a corresponding groove of the pump chamber wall 30.

The section 12 is connected to the dispenser head 4 in a rotationally rigid fashion. A displacement of the dispenser head 4 in the direction of the dispenser axis x results in the coupled motion of the section 13 featuring the pump piston 10 over the section 12.

The facing regions of the sections 12 and 13 are nested in one another. The end section of the section 12, which penetrates into the section 13, forms flow-through openings 14 that extend outward radially to the dispenser axis x and are connected to the centrally arranged dispensing tube 11.

The outlet valve 8 is formed in the region of a base 15 that separates the pump chamber 6 from the dispensing tube 11. The base 15 preferably is part of the section 13 and furthermore preferably forms the piston head.

The dispensing tube 11 transforms into a discharge channel 16, which is essentially oriented radially to the dispenser axis x and ends in the dispenser mouth 5.

The dispenser head 4 can be displaced relative to the dispenser body 3 along the dispenser axis x and is in this case supported on the dispenser body 3 by means of a spring 17, particularly a pressure spring. The dispenser head 4 is spring-loaded in the direction of an extended position by means of the spring 17, which in the exemplary embodiment is realized in the form of a separate cylindrical pressure spring.

The dispenser head 4 can furthermore be rotated relative to the dispenser body 3 about the dispenser axis x, particularly by 90 degrees, from a closed position into an open position and vice versa.

Figure 17:
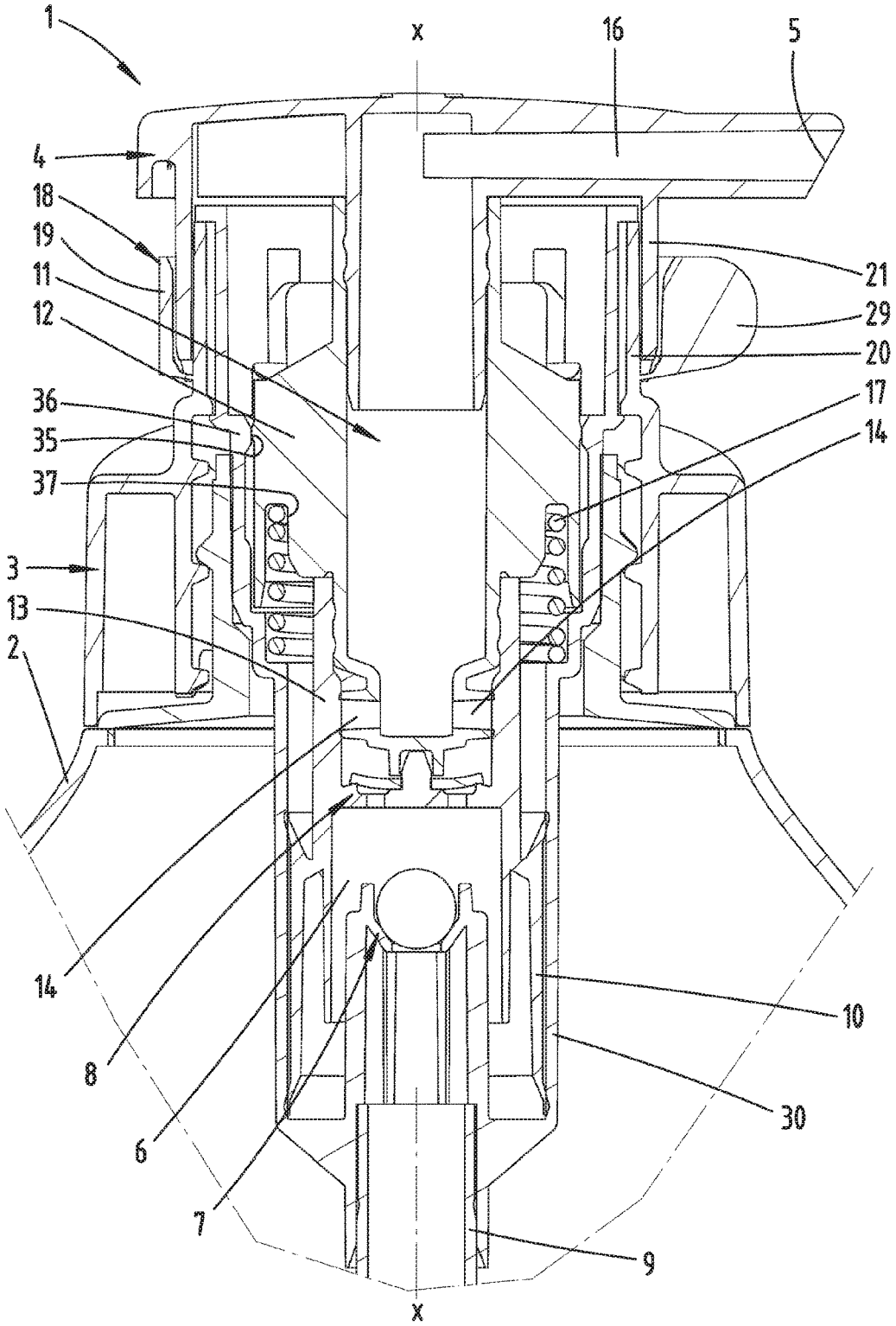
FIG. 17 shows a sectional representation according to FIG. 4 concerning a second embodiment.
Figure 18:
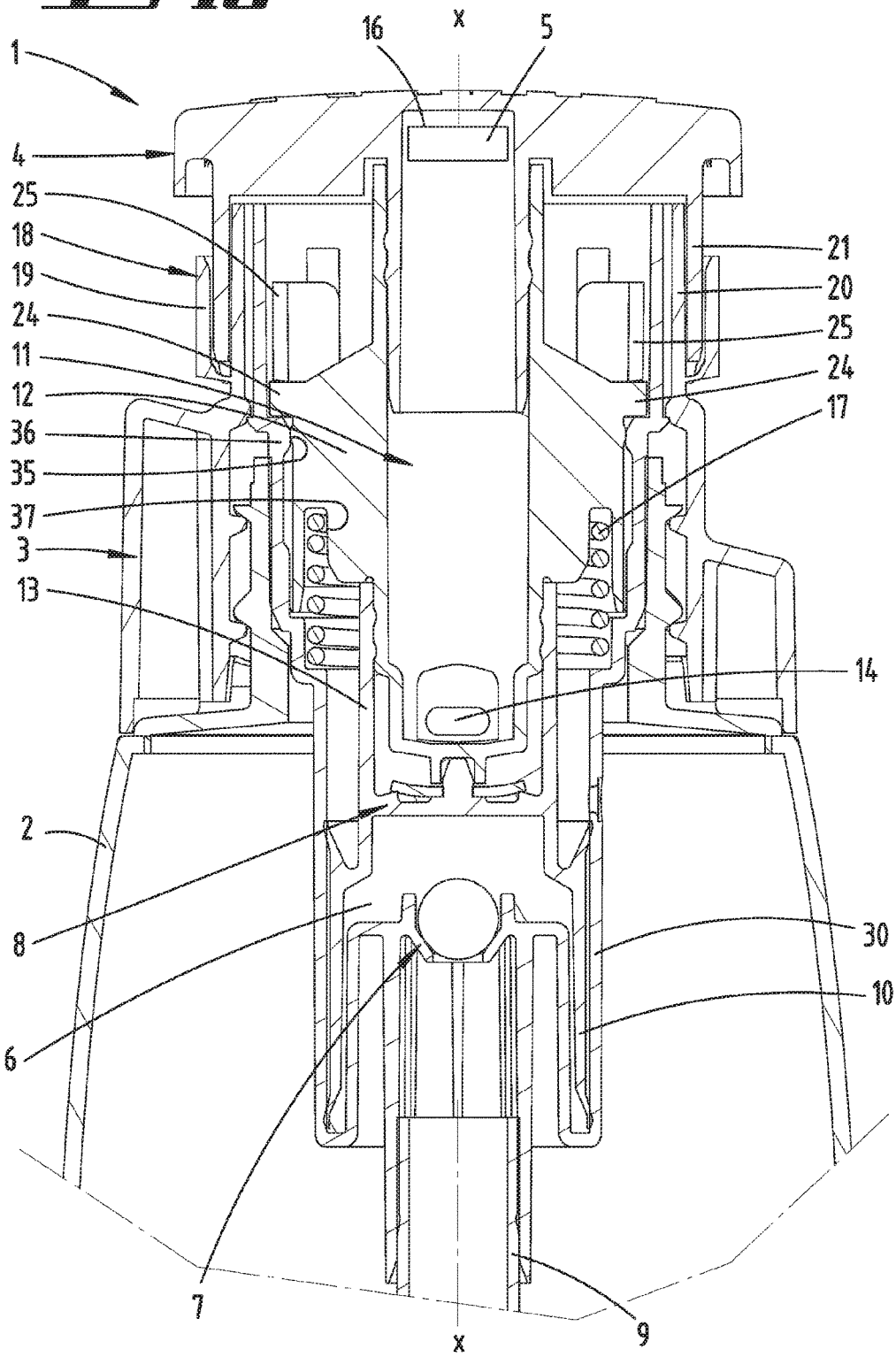
FIG. 18 shows the second embodiment in the form of a sectional representation according to FIG. 5.

The closed position in the retracted position of the dispenser head 4, which is illustrated in the first embodiment according to FIGS. 1-6, as well as in the second embodiment according to FIGS. 17 and 18, preferably is the delivery position prior to an initial use of the dispenser 1. This delivery position may be secured by means of a tamper-proofing part 18.

In the exemplary embodiment shown, the tamper-proofing part 18 is realized in the form of a tamper-proofing ring 19, which circumferentially encloses the outer side of a dispenser head neck 21, which telescopically cooperates with a dispenser body neck 20, underneath the dispenser mouth 5.

The tamper-proofing ring 19 is connected to the dispenser body 3 by means of material bridges 22 that are uniformly distributed over the circumference, preferably as a result of realizing the tamper-proofing ring 19 and the dispenser body 3 integrally and of the same material.

The material bridges 22 are realized in a web-like fashion and in the embodiments illustrated in FIGS. 1-18 simultaneously form interlocking projections 31, which are spaced apart from one another in the circumferential direction.

The facing peripheral edge of the dispenser head neck 21 engages into the intermediate spaces between two circumferentially adjacent interlocking projections 31 with axially oriented interlocking recesses 23.

When the tamper-proofing ring 19 is attached to the dispenser body 3, the dispenser head 4 is therefore prevented from rotating as a result of the interlock between the interlocking recesses 23 and the interlocking projections 31.

In this lowered closed position, which can also be reassumed after the removal of the tamper-proofing part 18, the dispenser head 3 is secured in the retracted position. This is achieved in that locking shoulders 24, which protrude radially outward from the outer side of the dispensing tube section 12, engage in this closed position underneath locking sections 25 of the dispenser body 3, which protrude radially inward. In this position, the dispenser head 4 cannot be displaced into the extended position.

Figure 4:
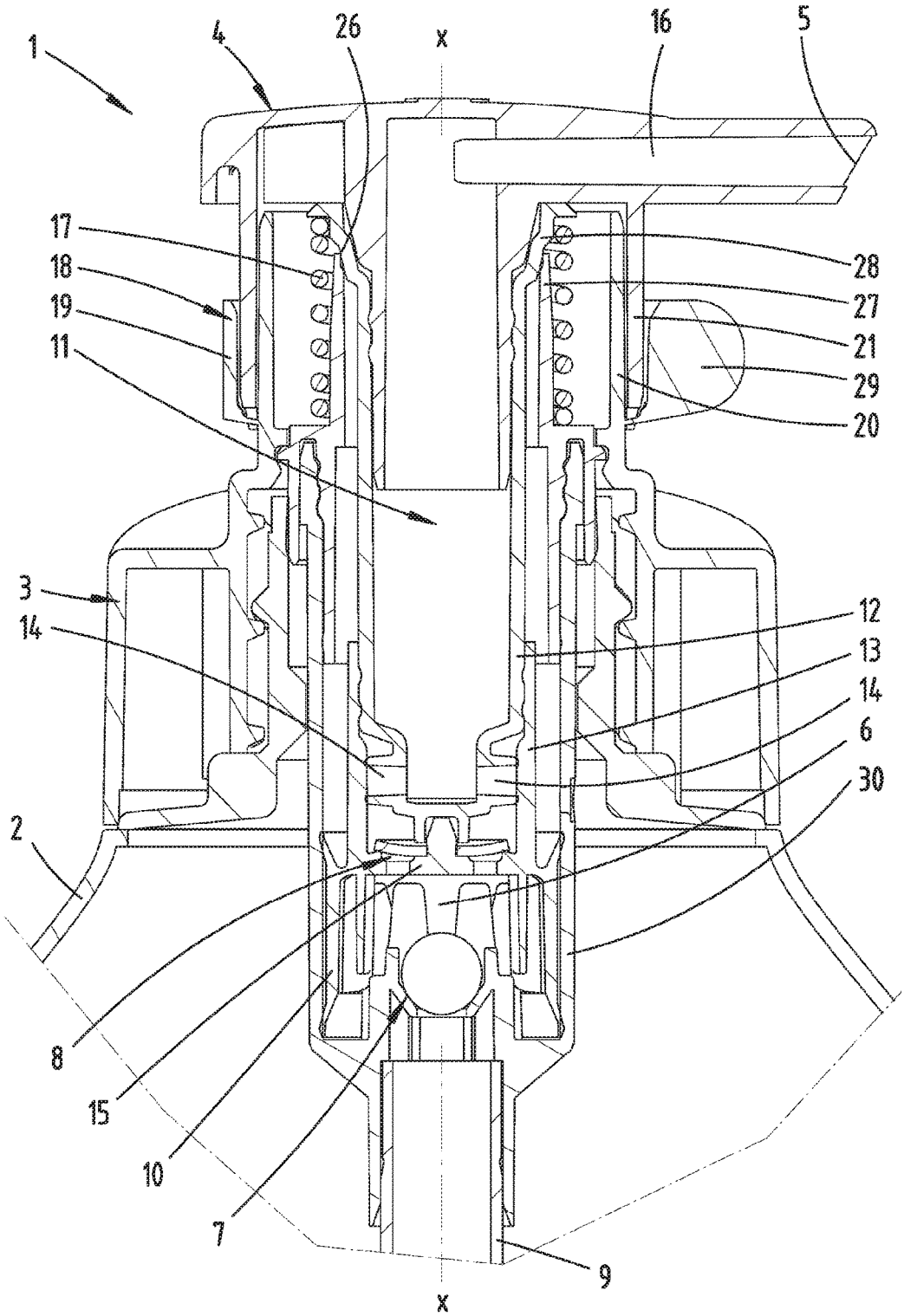
FIG. 4 shows the section along the line IV-IV in FIG. 3.
Figure 5:
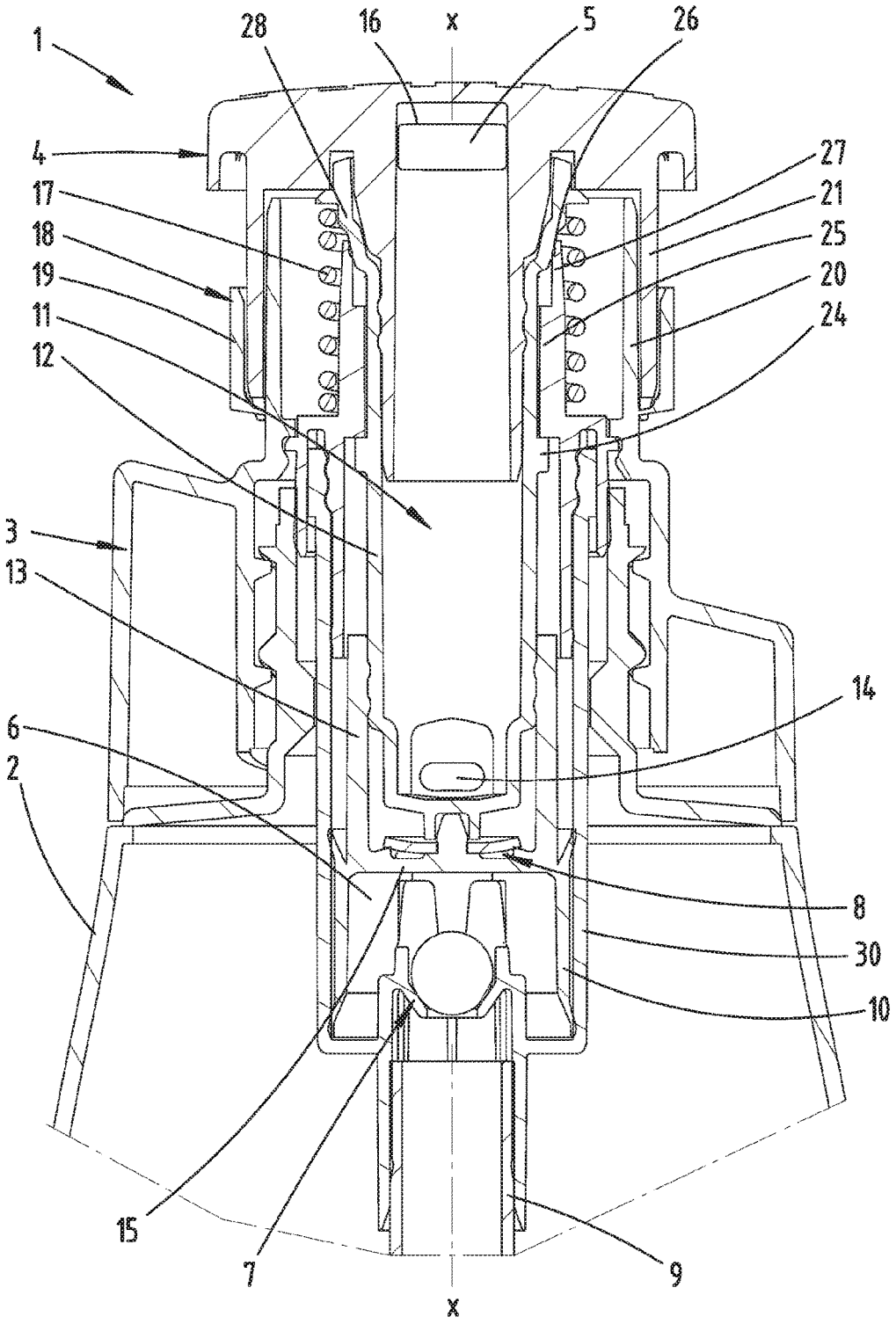
FIG. 5 shows the section along the line V-V in FIG. 2.
Figure 6:
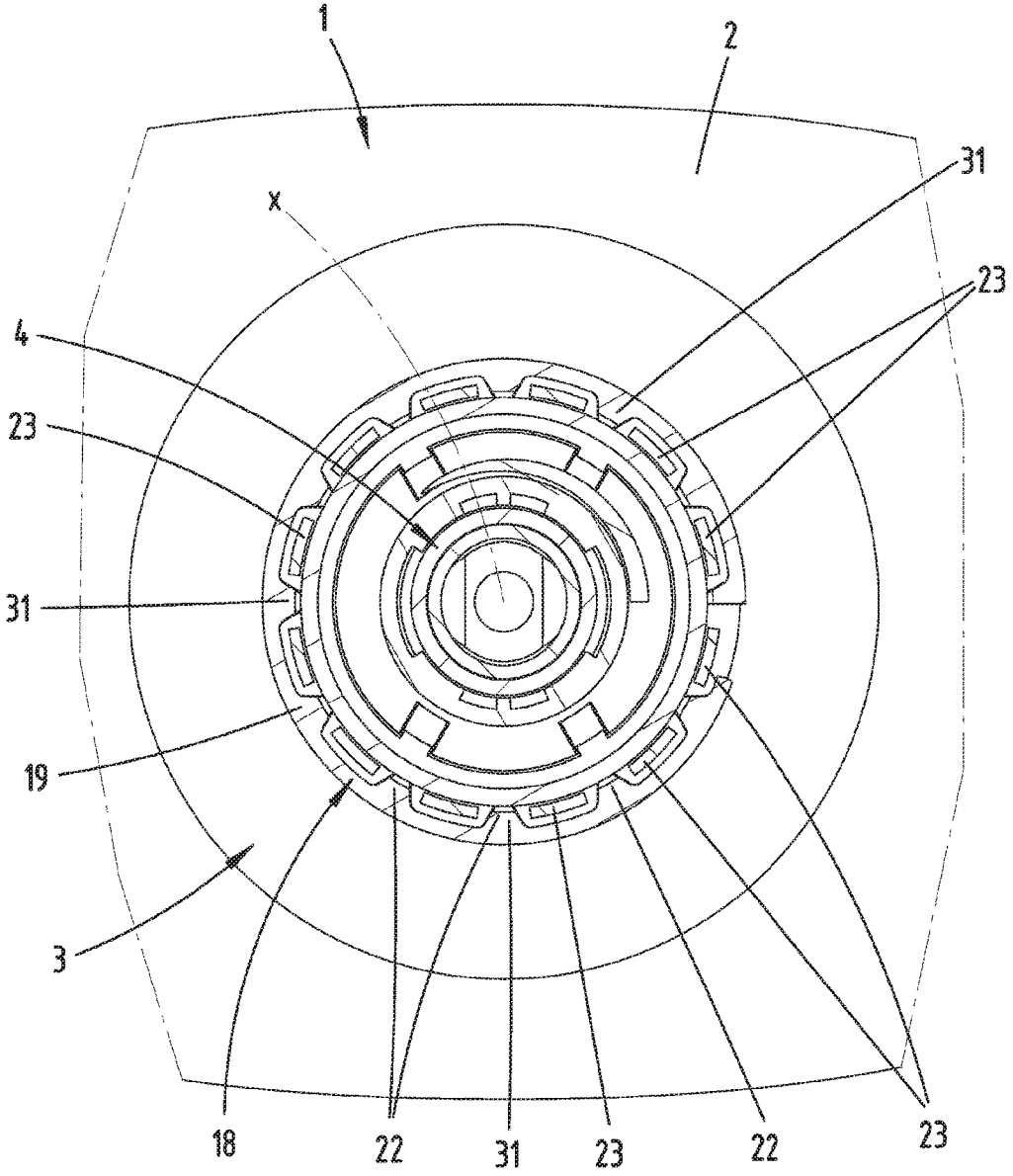
FIG. 6 shows the section along the line VI-VI in FIG. 2.
Figure 7:
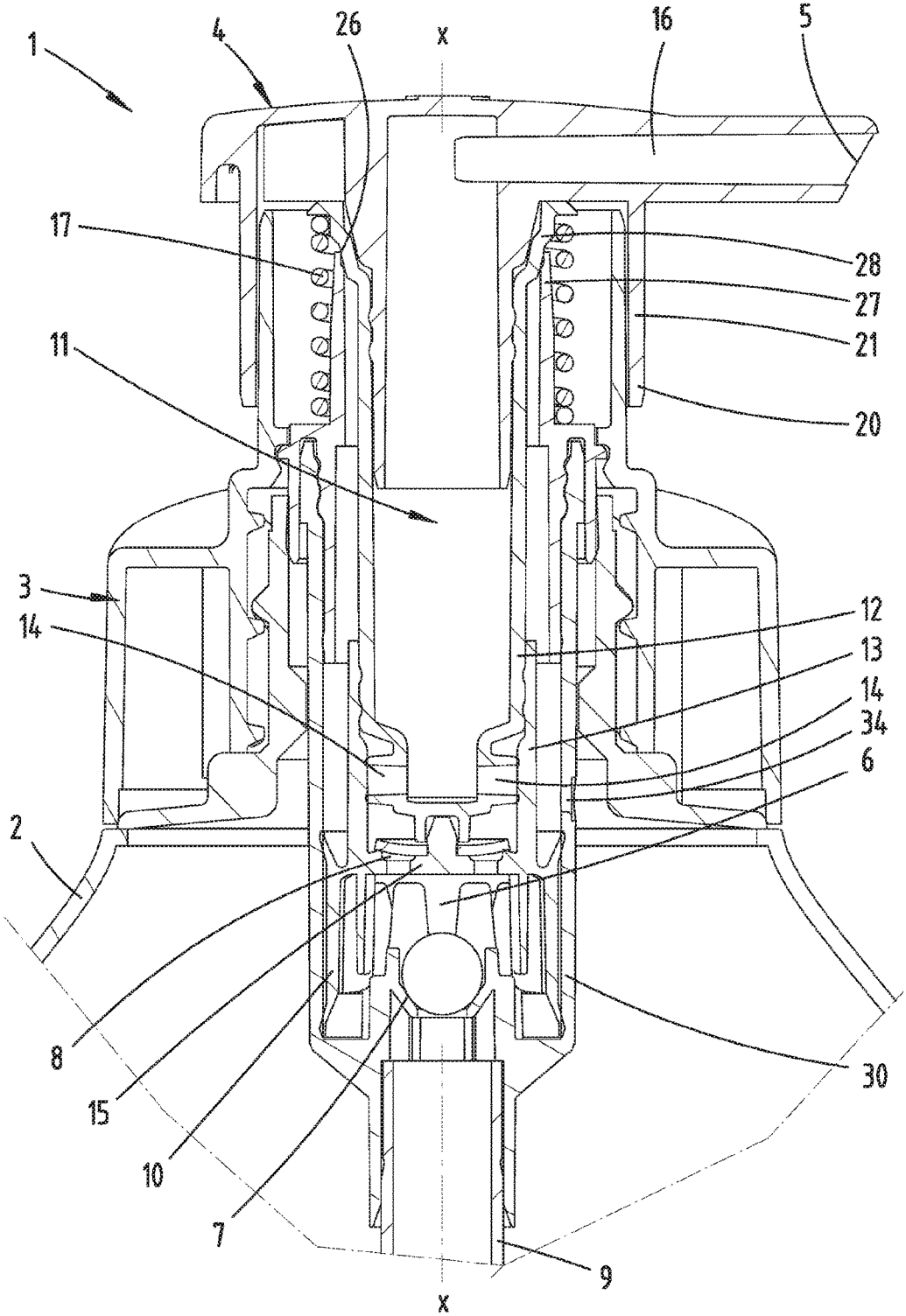
FIG. 7 shows a representation corresponding to FIG. 4, however, after the removal of a tamper-proofing part.
Figure 8:
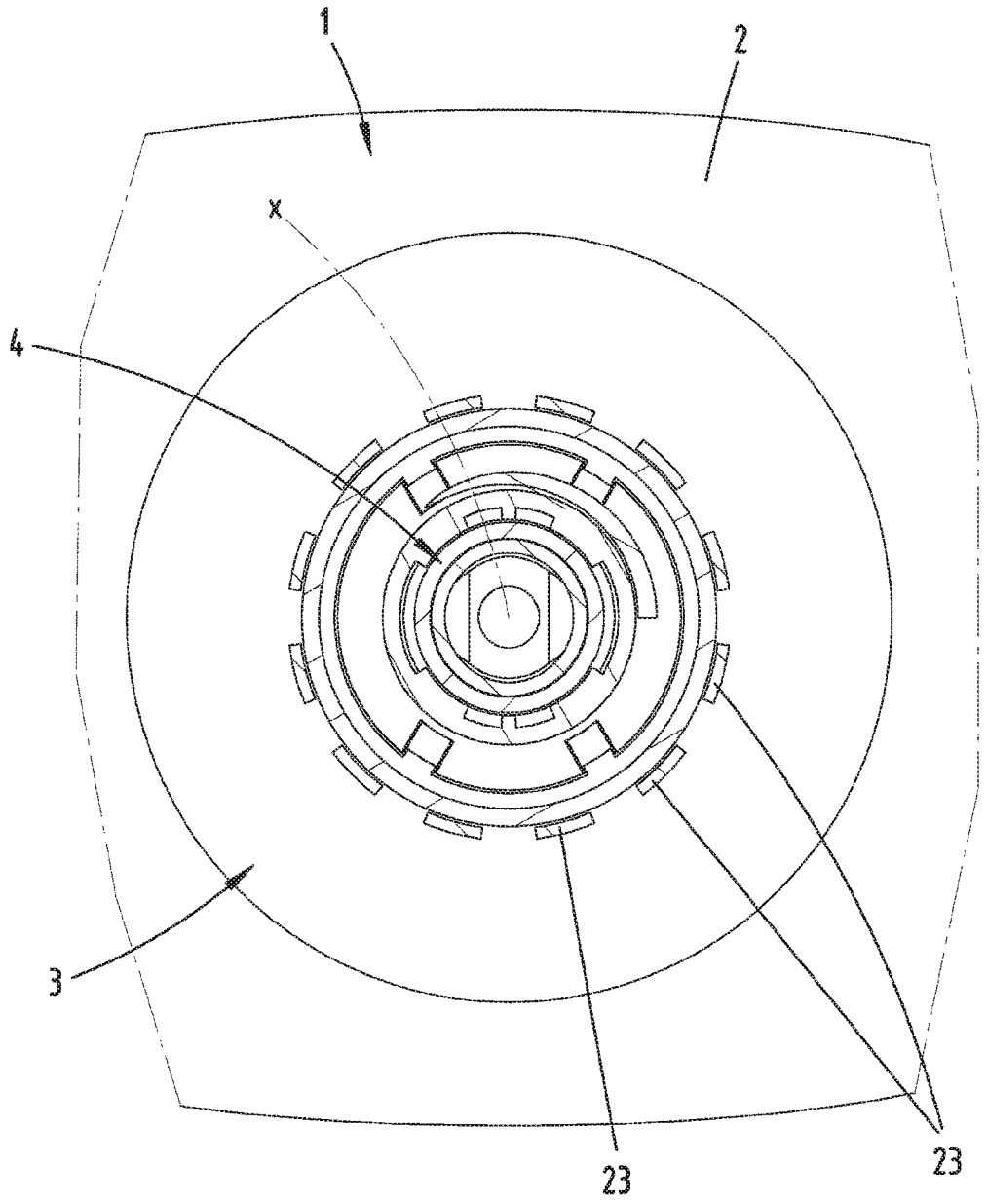
FIG. 8 shows a representation corresponding to FIG. 6, however, also after the removal of the tamper-proofing part.

The flow-through openings 14 of the section 12 are also shut in this closed position as a result of being sealed relative to wall sections of the section 13, which protrude radially inward (see FIG. 4).

Furthermore, a ventilation opening 26 for the container space is shut in the lowered closed position as a result of the circumferential contact of a dispenser body section 27 with an opposite sealing section 28 of the dispenser head 4 similar to a lip seal.

Figure 10:
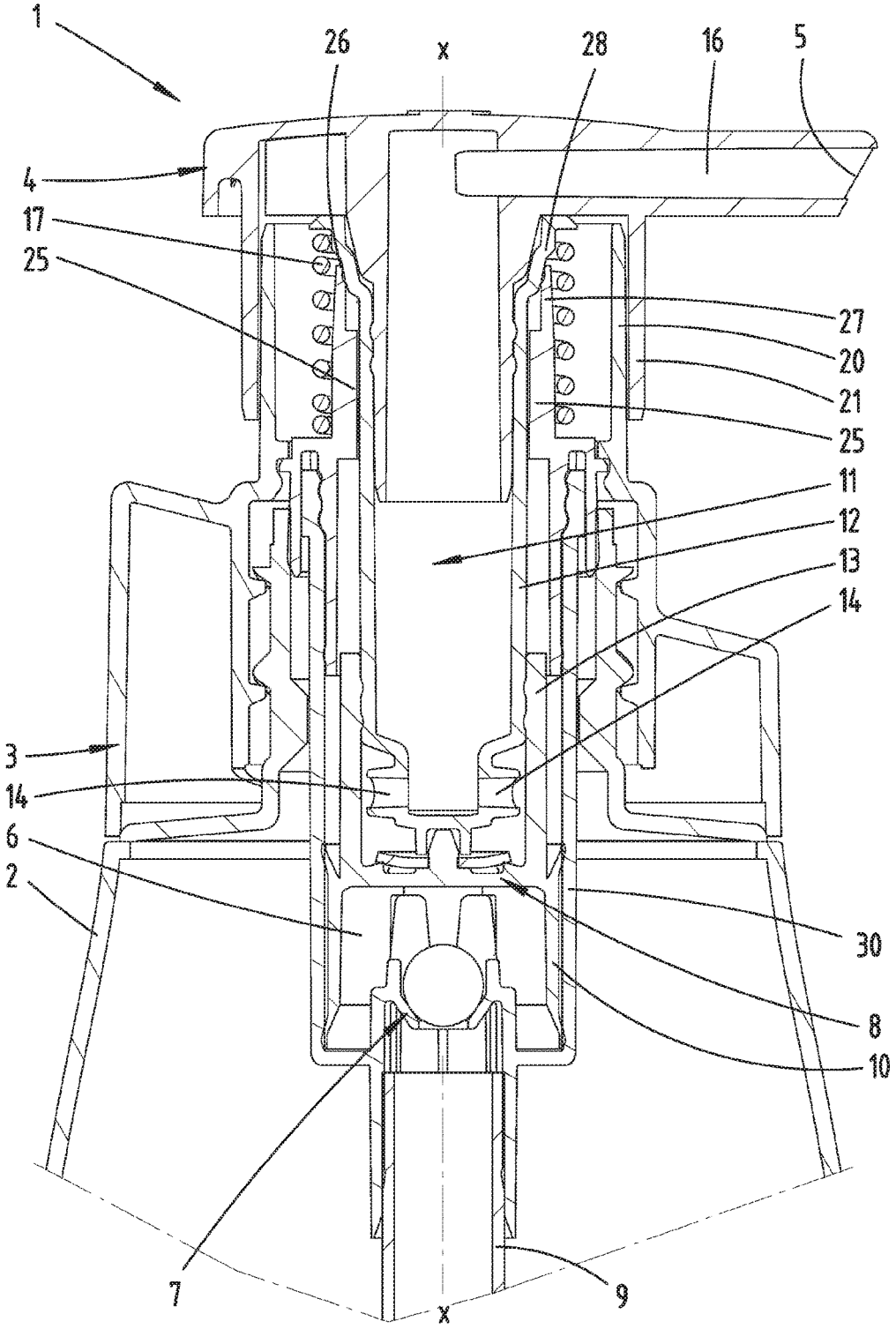
FIG. 10 shows a sectional representation according to FIG. 5, however, concerning the dispenser head position in FIG. 9.
Figure 15:
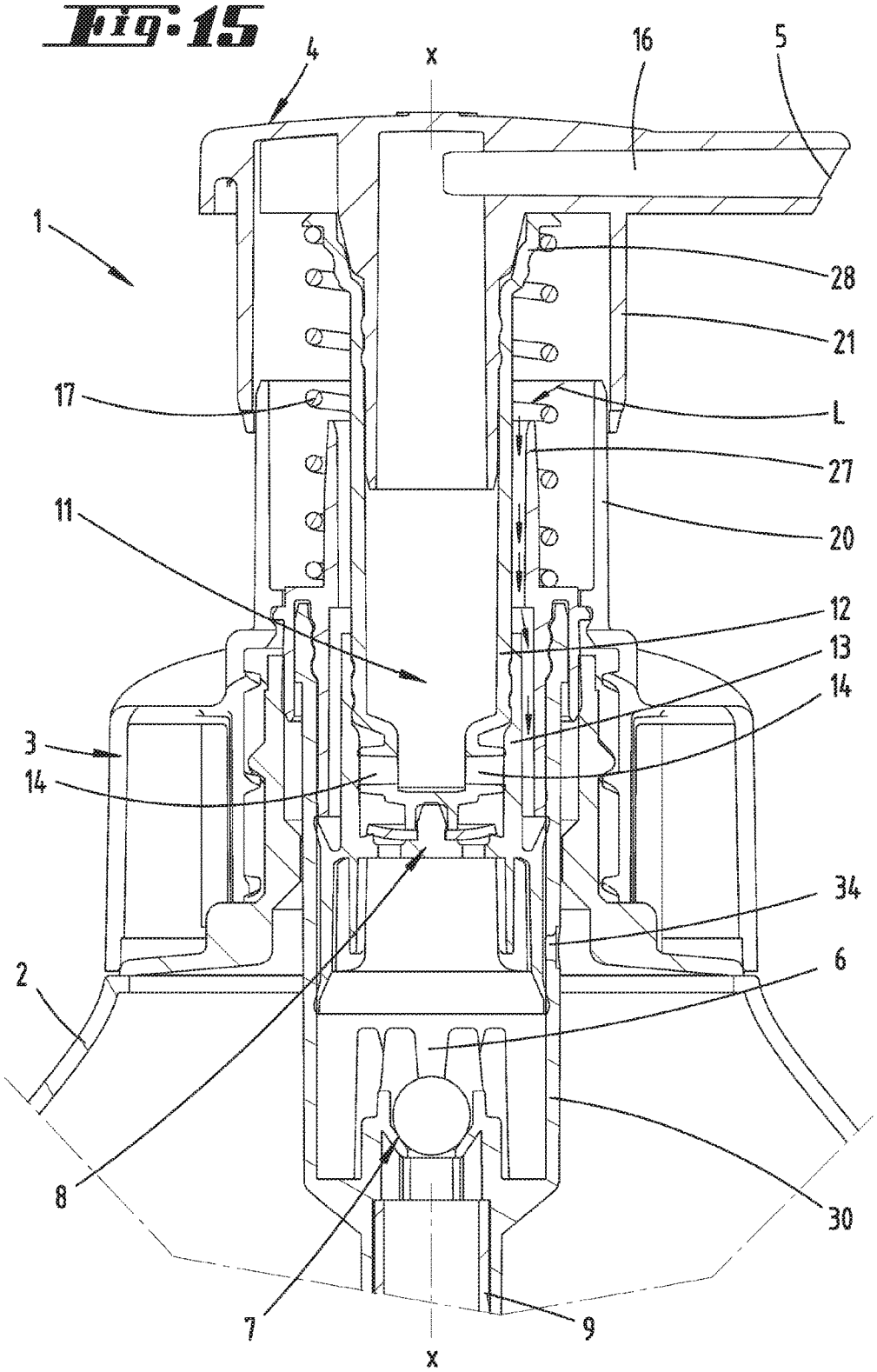
FIG. 15 shows another representation corresponding to FIG. 9, however, with the dispenser head locked in the extended position.
Figure 22:
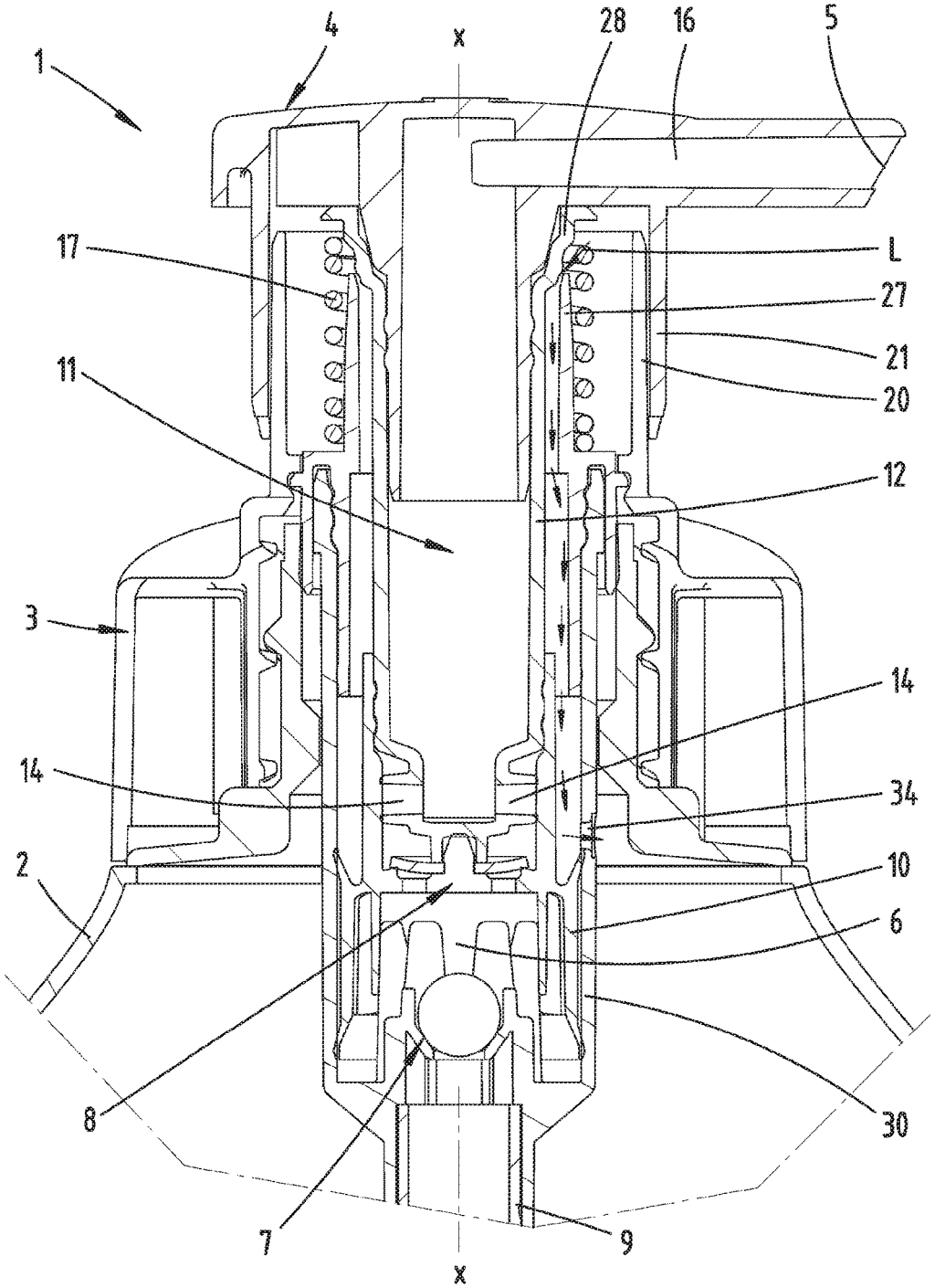
FIG. 22 shows a representation corresponding to FIG. 15, however, concerning an intermediate position of the dispenser head.

In an intermediate position according to FIG. 22 between the extended position illustrated, e.g., in FIG. 15 and a retracted position illustrated, e.g., in FIG. 10, air can be drawn into the interior of the container 2 along an air path L through a ventilation opening 34 in the pump chamber wall 30. This constellation exists during the course of an extension, as well as the retraction. This constellation occurs analogously in the second embodiment according to FIGS. 17 and 18, but is not specifically illustrated.

Figure 9:
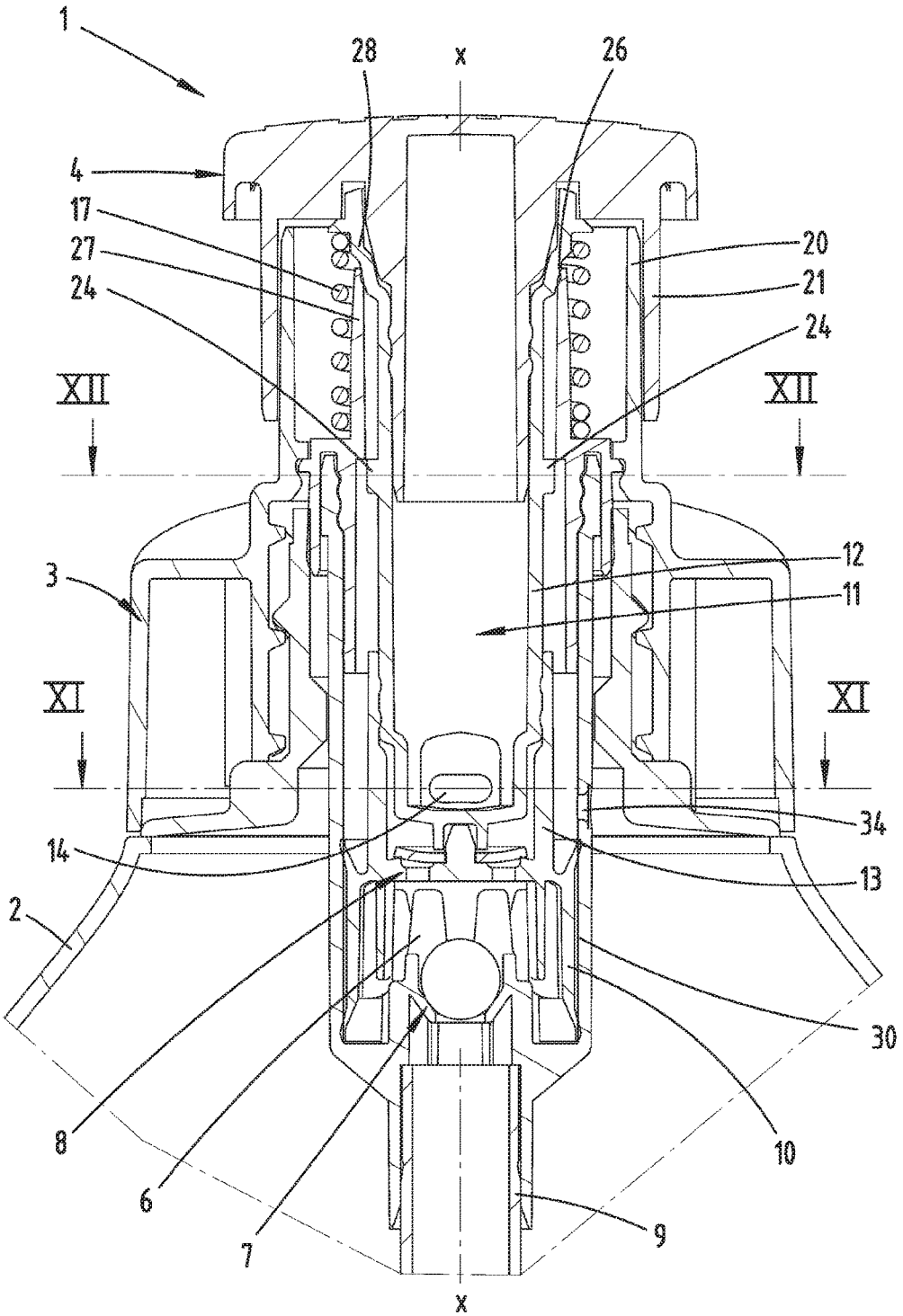
FIG. 9 shows a sectional representation corresponding to FIG. 4 after the rotation of the dispenser head from the closed position into an open position.

The tamper-proofing part can be ruptured as a result of deliberately rotating the dispenser head 4 from the closed position into the open position according to FIGS. 9 and 10. In the process, the material bridges 22 are torn off the dispenser body 3 by the interlocking recesses 23. The tamper-proofing ring 19 can then loosely rest on the dispenser body 3 such that it neither restricts the ability to rotate nor the ability to linearly displace the dispenser head 4.

The tamper-proofing ring 19 can also be completely torn off the dispenser body 3 by means of a tab-like handle 29.

The section 12 featuring the flow-through openings 14 is rotated relative to the section 13 featuring the pump piston 10 by rotating the dispenser head 4, preferably by degrees, such that the flow-through openings 14 are moved into a flow-through position as illustrated in FIGS. 9 and 10. In this case, the mouths of the flow-through openings 14 are radially spaced apart from the wall section of the section 13.

Figure 11:
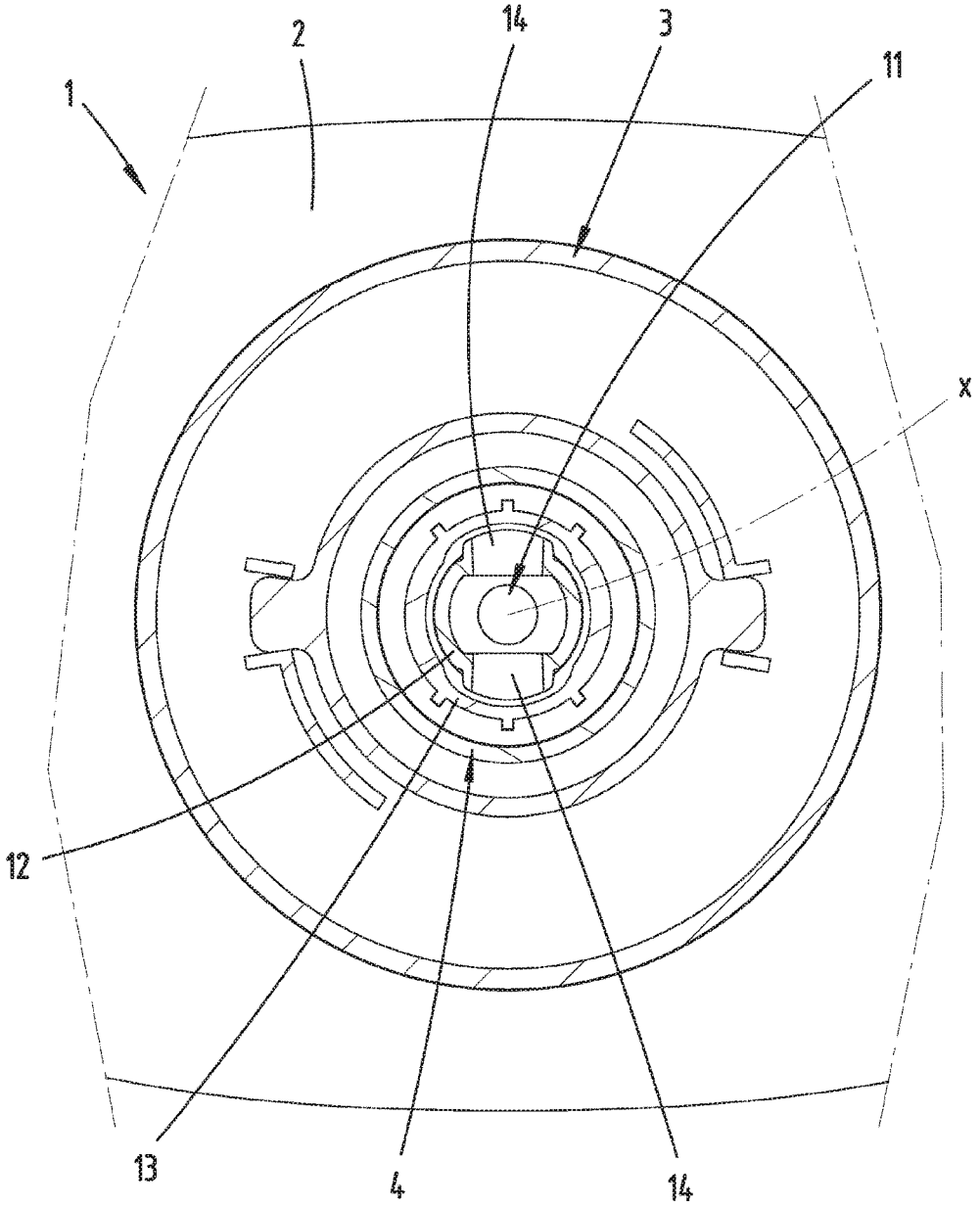
FIG. 11 shows the section along the line XI-XI in FIG. 9.

This is achieved, for example, as a result of a material taper of the wall regions of the section 13, which correspond in this position (see FIG. 11).

Figure 12:
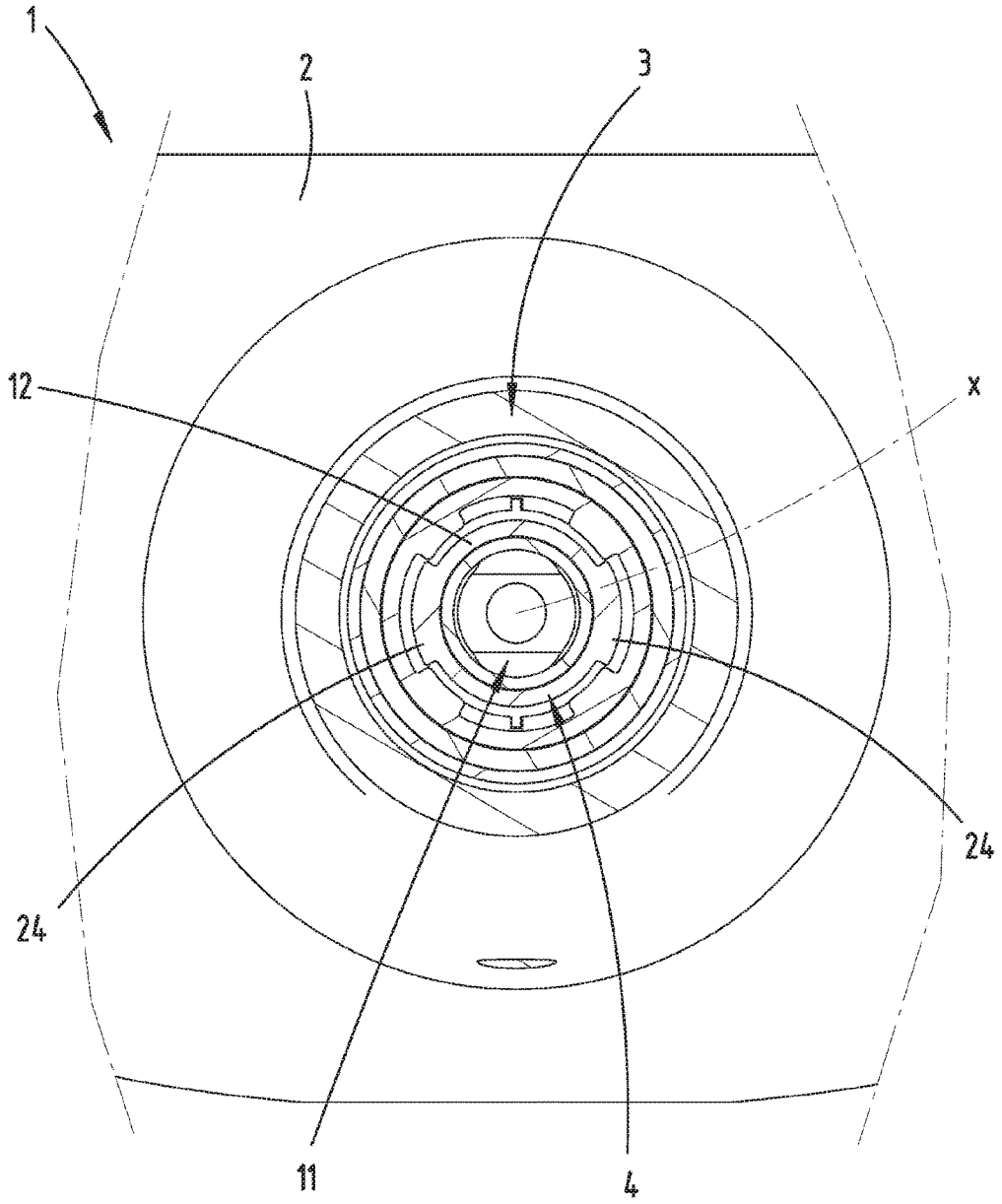
FIG. 12 shows the section along the line XII-XII in FIG. 9.

The locking shoulders 24 of the section 12 are at the same time rotationally displaced into a position, in which they are no longer overlapped by the locking sections 25 on the side of the dispenser body (see FIG. 12).

After its rotation from the closed position into the open position, the dispenser head 4 is spring-loaded in the direction of the extended position by means of the spring 17, wherein the substance is drawn into the pump chamber 6 through the inlet valve 7 during this linear displacement of the dispenser head 4.

In this position, the dispenser 1 is in the usage position. The substance is discharged from the pump chamber 6 through the outlet valve 8 and the flow-through openings 14 and dispensed through the dispensing tube 11 by lowering the dispenser head 4.

The ventilation opening 26 is unblocked in the extended position of the dispenser head 4 such that air can flow into the interior of the container 2 through this ventilation opening between the telescopically cooperating sections of the dispenser body 3 and the dispenser head 4.

Figure 13:
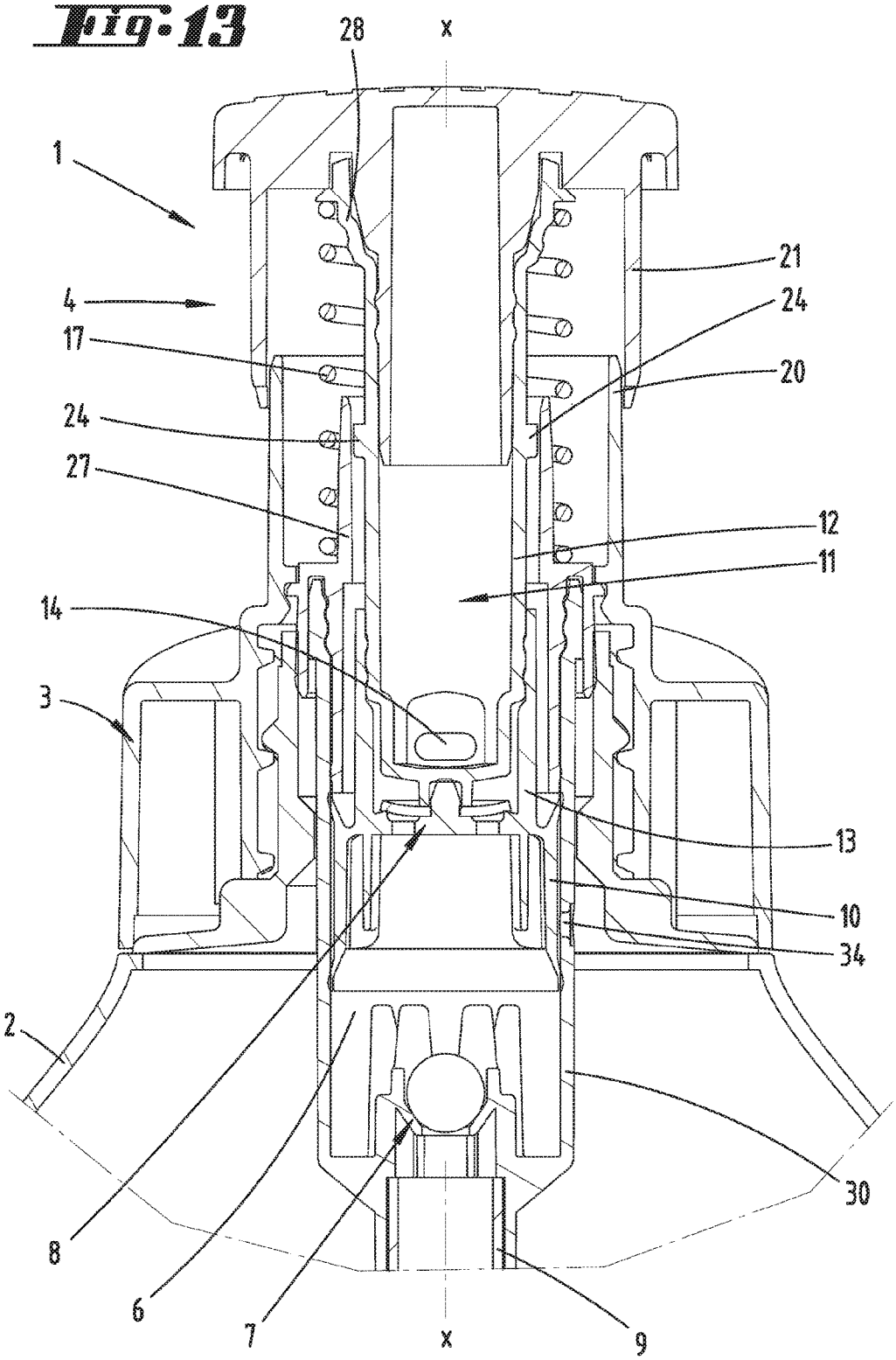
FIG. 13 shows a sectional representation corresponding to FIG. 9, however, with the dispenser head displaced into the extended position.
Figure 14:
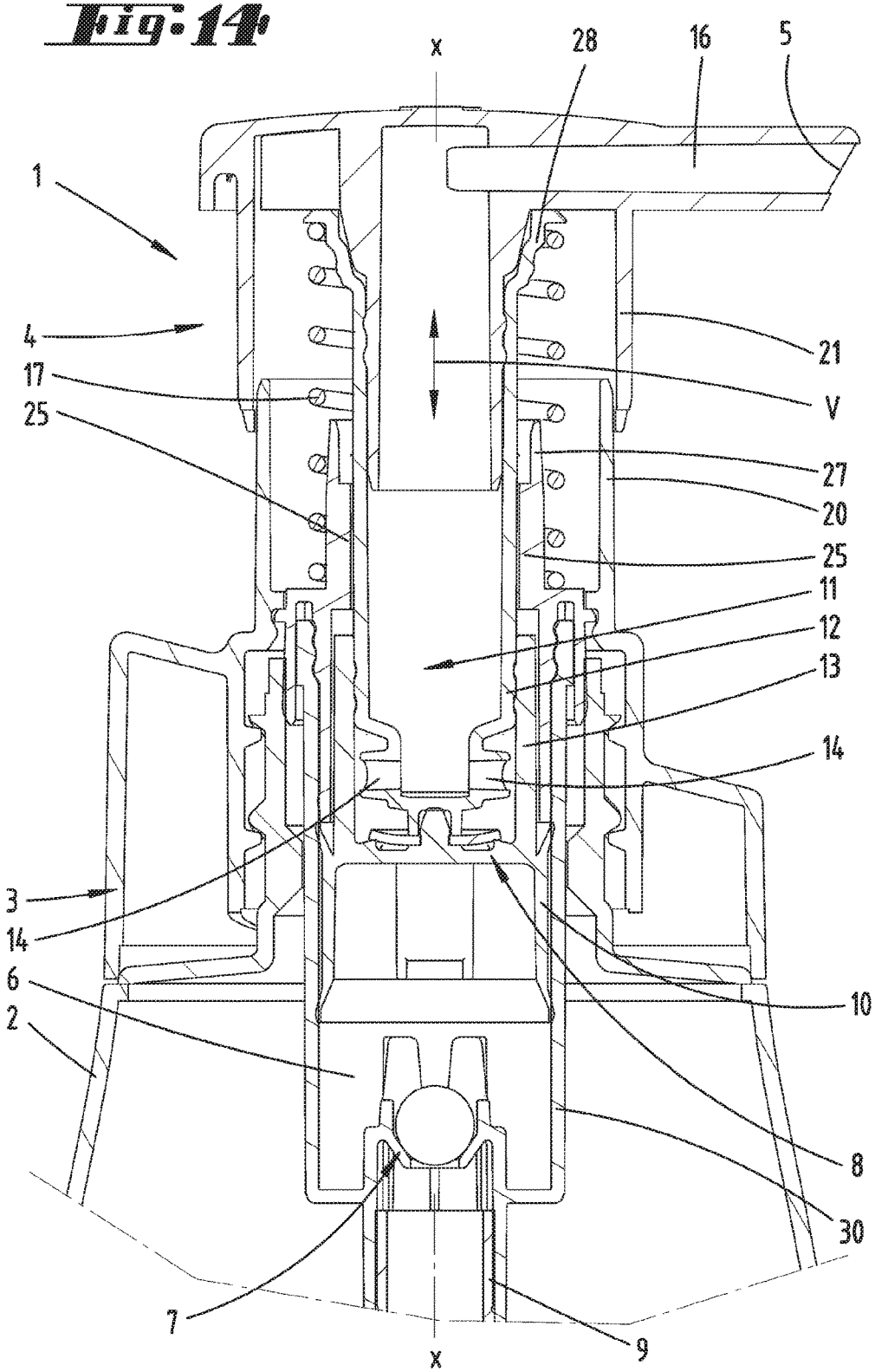
FIG. 14 shows a sectional representation corresponding to FIG. 10 concerning the dispenser head position in FIG. 13.

FIGS. 13 and 14 show the dispenser 1 in the extended position of the dispenser head 4, in which the dispenser is ready for use.

Figure 16:
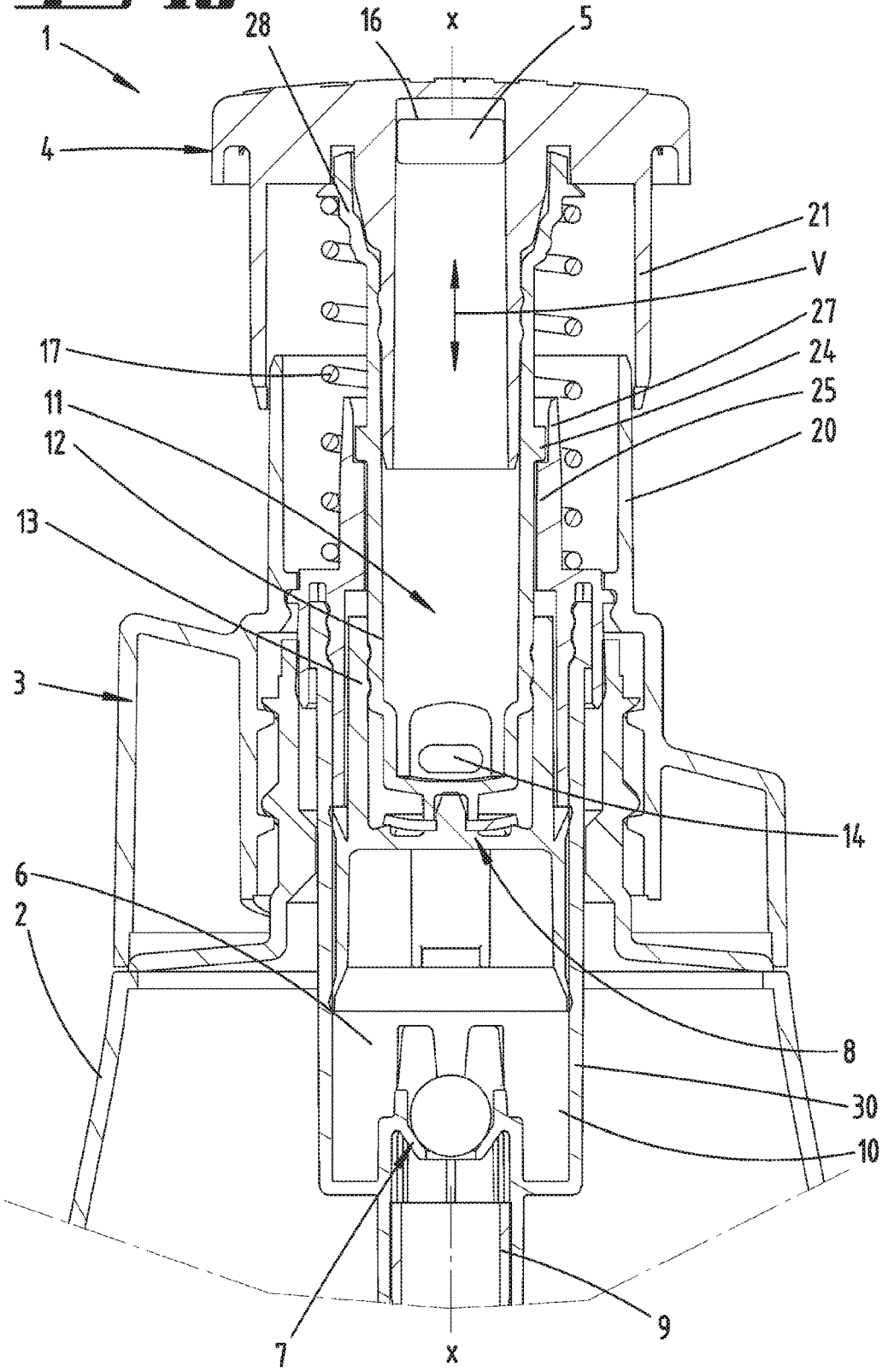
FIG. 16 shows a representation corresponding to FIG. 10 concerning the locked position in FIG. 15.

In this extended position, the dispenser head 4 can also be rotated back into a closed position, particularly for realizing a transport safety. An example of this position is illustrated in FIGS. 15 and 16.

In addition, the flow-through openings 14 are shut in this position as a result of the cooperation with a radially constricted region of the section 13 (see FIG. 15). Furthermore, the axial displacement (pumping motion) of the dispenser head 4 is also prevented in this position as a result of the support of the locking shoulders 24 on the locking sections 25 of the dispenser body 3 (see FIG. 16).

In the embodiment according to FIGS. 17 and 18, the ventilation opening 26 is in the lowered closed position illustrated in these figures formed by an annular groove 35 on the section 12, which cooperates with a corresponding projection 36 on the pump chamber wall 30 that is additionally raised in this region. Furthermore, the same region of the section 12, which is also enlarged in a wing-like fashion in this region and with respect to this cross section, forms an internal receptacle 37 for the spring 17. In the first embodiment, the spring 17 is seated on the underside of the dispenser body section 27 whereas the spring 17 is in the embodiment according to FIGS. 17 and 18 seated on the underside of an internal shoulder of the pump chamber wall 30.

Figure 20:
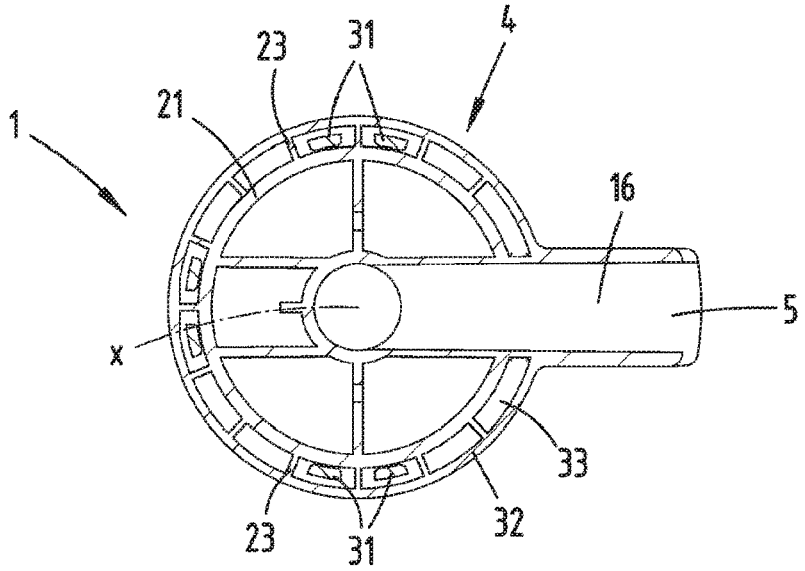
FIG. 20 shows the section along the line XX-XX in FIG. 19.
Figure 19:
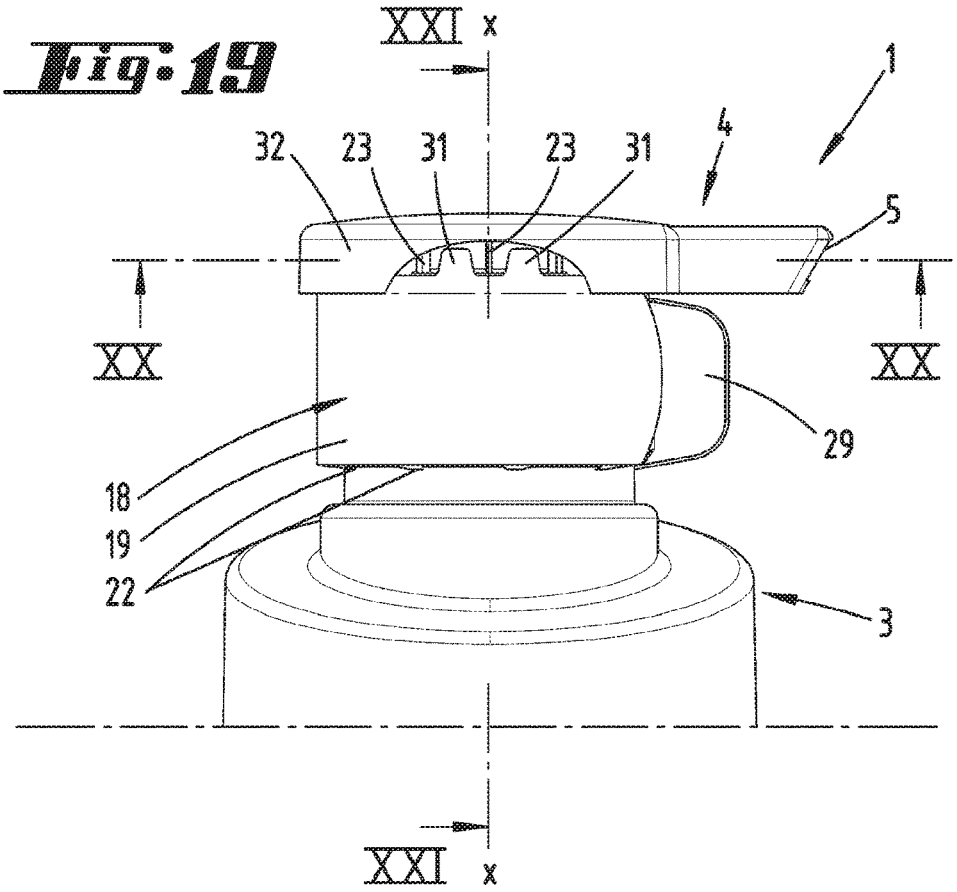
FIG. 19 shows a partially broken-up side view of a dispenser head with a tamper-proofing part concerning another embodiment.
Figure 21:
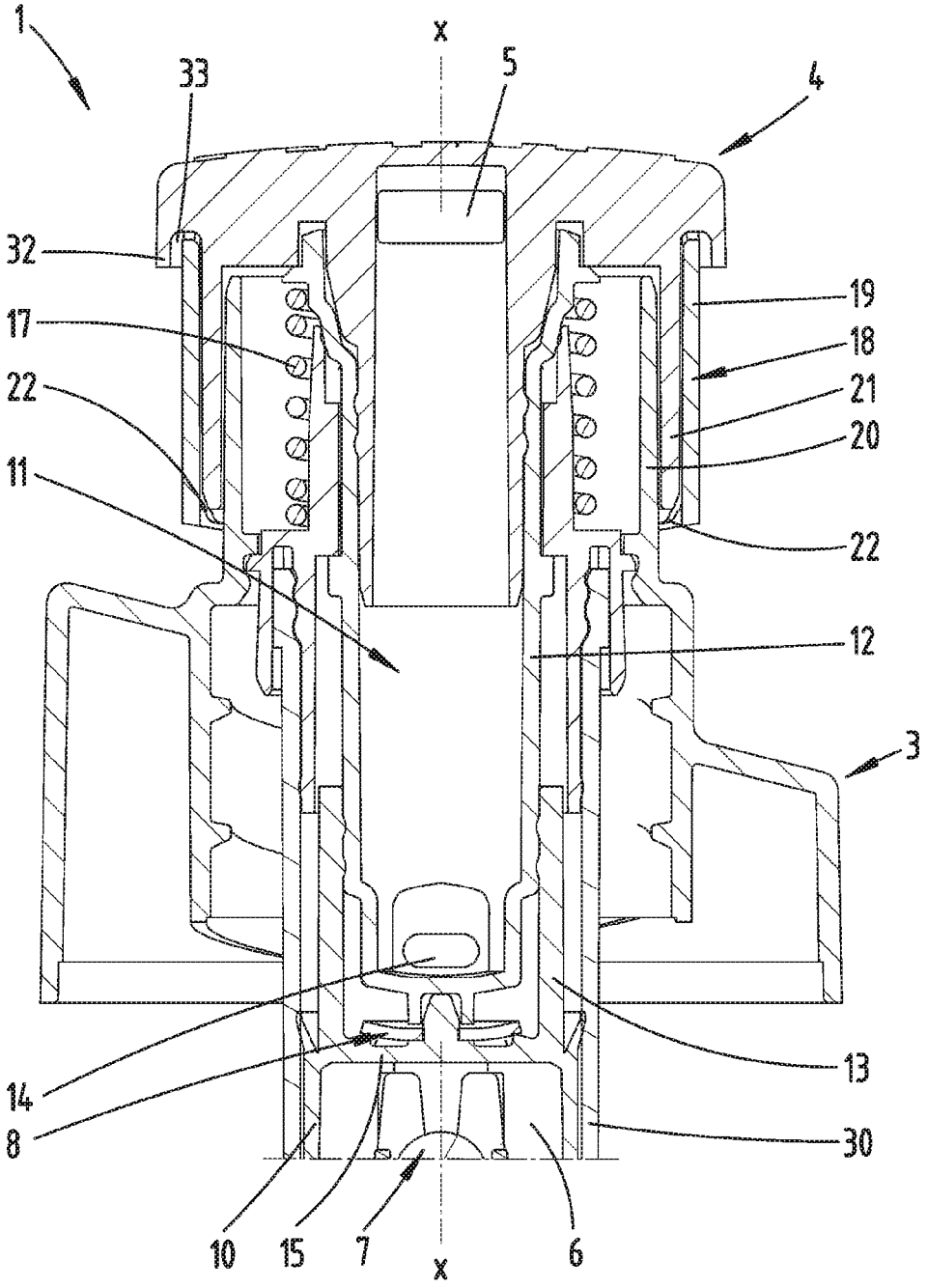
FIG. 21 shows the section along the line XXI-XXI in FIG. 19.

FIGS. 19-21 show another embodiment, in which the connection of the tamper-proofing part 18 (tamper-proofing ring 19) to the dispenser body 3 is realized by means of circumferentially distributed material bridges 22 analogous to the above-described embodiments. This connection may be produced along a lower peripheral edge of the tamper-proofing ring 19 as shown.

The dispenser head 4 forms a circumferential skirt region 32 that is assigned to the actuating end and defines an annular groove 33 formed between the skirt and the dispenser head neck 21 in the radially outward direction. When the tamper-proofing part is intact, the interlocking recesses 23 on the side of the dispenser head and the interlocking projections 31 on the side of the tamper-proofing ring are interlocked in the region of this annular groove 33 (see also FIG. 20).

The interlocking recesses 23 of the dispenser head 4 are realized in the form of radial webs that cross the annular groove 33. An interlocking projection 31, which is essentially oriented axially, engages between two interlocking recesses 23 that are spaced apart in the circumferential direction.

The axial clearance between a lower peripheral edge of the skirt region 32 and a surface of the dispenser body 3, which is approximately oriented along a horizontal plane, can preferably be chosen larger than the height of the tamper-proofing part 18 (if applicable including its interlocking projections 31) in the same direction such that the tamper-proofing part 18 can slide down as far as the surface of the dispenser body 3 after the material bridges 22 have been ruptured and is then accessible for its removal. In any case, the tamper-proofing part is accessible for being removed at least after an axial upward displacement of the dispenser head 4.

The preceding explanations serve for elucidating all inventions that are included in this application and respectively enhance the prior art independently with at least the following combinations of characteristics, namely:

A dispenser 1, which is characterized in that the dispenser 1 features a tamper-proofing part 18, which is secured on two parts of the dispenser 1 that can rotate relative to one another, wherein the tamper-proofing part is secured on one of the two parts by means of a rupturable material bridge 22 and the material bridge 22 can be ruptured during the course of a rotation of the dispenser head 4.

A dispenser 1, which is characterized in that the dispenser head 4 is in the retracted position when the tamper-proofing part 18 is intact.

A dispenser 1, which is characterized in that the dispenser head 4 is in any case spring-loaded in the direction of the extended position at the end of the rotation.

A dispenser 1, which is characterized in that the tamper-proofing part 18 is in its intact condition connected to the dispenser body 3 by means of the material bridge 22 and interlocked with the dispenser head 4 in order to produce a rotational coupling.

A dispenser 1, which is characterized in that the tamper-proofing part 18 is connected to the dispenser body 3 by means of material bridges 22 that are distributed over the circumference of the dispenser body 3.

A dispenser 1, which is characterized in that the tamper-proofing part 18 features interlocking projections 31 for cooperating with interlocking recesses 23 of the dispenser head 4.

A dispenser 1, which is characterized in that the dispenser head 4 features one or more interlocking recesses 23, which respectively engage between two interlocking projections 31 of the tamper-proofing part 18.

A dispenser 1, which is characterized in that the interlocking projections 31 and the interlocking recesses 23 are covered by a skirt region 32 of the dispenser head 4 when the tamper-proofing part is intact.

A dispenser 1, which is characterized in that the tamper-proofing part 18 consists of a tamper-proofing ring 19 extending underneath the dispenser mouth (5).

All disclosed characteristics are essential to the invention (individually, but also in combination with one another). The disclosure content of the associated/attached priority documents (copy, of the priority application) is hereby fully incorporated into the disclosure of this application, namely also for the purpose of integrating characteristics of these documents into claims of the present application. The characteristic features of the dependent claims characterize independent inventive enhancements of the prior art, particularly for submitting divisional applications on the basis of these claims.

LIST OF REFERENCE SYMBOLS

1 Dispenser
2 Container
3 Dispenser body
4 Dispenser head
5 Dispenser mouth
6 Pump chamber
7 Inlet valve
8 Outlet valve
9 Substance suction tube
10 Pump piston
11 Dispensing tube
12 Section
13 Section
14 Flow-through opening
15 Base
16 Discharge channel
17 Spring
18 Tamper-proofing part
19 Tamper-proofing ring
20 Dispenser body neck
21 Dispenser head neck
22 Material bridge
23 Interlocking recess
24 Locking shoulder
25 Locking section
26 Ventilation opening
27 Dispenser body section
28 Opposite sealing section
29 Handle
30 Pump chamber wall
31 Interlocking projection
32 Skirt region
33 Annular groove
34 Ventilation opening
35 Annular groove
36 Projection
37 Internal receptacle
x Dispenser axis
L Air path
V Displacement direction

The invention claimed is:

1. A dispenser comprising:

a dispenser head having a dispenser mouth, and a dispenser body, wherein the dispenser head is configured such that a substance can be dispensed from the dispenser mouth by pumping and the dispenser head can, when the dispenser is seated on a horizontally aligned bearing plane, be moved between an extended position and a retracted position in a displacement direction extending perpendicular to the horizontal bearing plane in order to carry out a pumping motion, wherein the dispenser head is configured to be rotatable relative to the dispenser body in such a way that the dispenser mouth moves in a horizontal plane during a rotation of the dispenser head, wherein the dispenser features a tamper-proofing part, which is secured on two parts of the dispenser that can rotate relative to one another, wherein the tamper-proofing part is secured on one of the two parts via rupturable material bridges, wherein the rupturable material bridges are formed via the tamper-proofing part and the dispenser body being realized integrally and of the same material, wherein the rupturable material bridges are configured to be ruptured during the course of a rotation of the dispenser head, and wherein the tamper-proofing part features interlocking projections for cooperating with interlocking recesses of the dispenser head.

2. The dispenser according to claim 1, wherein the dispenser head is in the retracted position when the tamper-proofing part is intact.

3. The dispenser according to claim 1, wherein the dispenser head is spring-loaded in a direction of the extended position at the end of the rotation.

4. The dispenser according to claim 1, wherein the tamper-proofing part is in an intact condition connected to the dispenser body by the rupturable material bridges and interlocked with the dispenser head in order to produce a rotational coupling.

5. The dispenser according to claim 1, wherein the rupturable material bridges are distributed over a circumference of the dispenser body.

6. The dispenser according to claim 1, wherein the interlocking recesses respectively engage between two interlocking projections of the interlocking projections of the tamper-proofing part.

7. The dispenser according to claim 1, wherein the interlocking projections and the interlocking recesses are covered by a skirt region of the dispenser head when the tamper-proofing part is intact.

8. The dispenser according to claim 1, wherein the tamper-proofing part comprises a tamper-proofing ring extending underneath the dispenser mouth.

* * * * *